US007076907B2

(12) United States Patent
Nesseth et al.

(10) Patent No.: US 7,076,907 B2
(45) Date of Patent: Jul. 18, 2006

(54) REAR GUN SIGHT DEVICE

(76) Inventors: Lawrence Arden Nesseth, 2242 18 3/4 Ave., Rice Lake, WI (US) 54868; Erik Lawrence Nesseth, 1288 130th Ave. #2, New Richmond, WI (US) 54017

( * ) Notice: Subject to any disclaimer, the term of this patent is extended or adjusted under 35 U.S.C. 154(b) by 56 days.

(21) Appl. No.: 10/887,480

(22) Filed: Jul. 9, 2004

(65) Prior Publication Data

US 2006/0005450 A1 Jan. 12, 2006

(51) Int. Cl.
*F41C 3/14* (2006.01)

(52) U.S. Cl. ..... 42/140; 42/138; 42/111

(58) Field of Classification Search ..... 42/140, 42/138, 111, 135, 147, 148, 124–128; 89/41.17, 89/41.19

See application file for complete search history.

(56) References Cited

U.S. PATENT DOCUMENTS

| | | | | | |
|---|---|---|---|---|---|
| 737,677 | A * | 9/1903 | Tansley | 42/140 |
| 834,785 | A * | 10/1906 | Wilkinson | 42/125 |
| 861,652 | A * | 7/1907 | Hawkins | 42/136 |
| 1,454,865 | A * | 5/1923 | Seely | 42/16 |
| 2,479,886 | A * | 8/1949 | Whittemore | 42/128 |
| 4,200,989 | A * | 5/1980 | Brouthers | 42/137 |
| 4,628,611 | A * | 12/1986 | Ruffino | 42/137 |
| 4,977,676 | A * | 12/1990 | Toupin | 42/138 |
| 5,522,166 | A * | 6/1996 | Martel | 42/124 |
| 5,533,292 | A * | 7/1996 | Swan | 42/123 |
| 6,622,415 | B1 * | 9/2003 | Canaday et al. | 42/140 |
| 6,732,467 | B1 * | 5/2004 | Luth | 42/138 |
| 6,779,290 | B1 * | 8/2004 | Houtsma | 42/148 |
| 2005/0188602 | A1 * | 9/2005 | Swan | 42/147 |

* cited by examiner

*Primary Examiner*—M. Clement
(74) *Attorney, Agent, or Firm*—Herman H Bains

(57) ABSTRACT

A rear sight device for an SKS or similar type rifle includes a sight base assembly and a sight component assembly. The sight component assembly is adjustable mounted on the sight base assembly and includes sight elements of well-known construction. The sight base assembly includes a vertical plate having locating arms which engage the side walls of the rifle receiver. A pivot bolt extending through openings in the locating arms, rifle receiver and cover mounts the sight device on the rifle. Adjustment screws on the vertical plate or locating arms urge planar pads on the vertical plate against the rear wall of the receiver plate against the rear wall of the receiver to firmly mount the rear sight device on the receiver.

16 Claims, 2 Drawing Sheets

REAR GUN SIGHT DEVICE

FIELD OF THE INVENTION

This invention relates to rear gun sights for rifles and more particularly to rear gun sights precisely and firmly mounted on the rear end portion of the rifle receiver.

BACKGROUND OF THE INVENTION

The novel rear gun sight device is especially adapted for use with a SKS type rifle. The gun sight includes a sight base assembly which can be mounted on the rear end portion of the rifle receiver. The vertical side walls of the receiver function as locating surfaces for the sight device and a pivot bolt secures the sight device to the receiver and cover with a minimum of alteration to the rifle. Adjustment elements on the sight base assembly mount the sight device securely on the receiver.

SUMMARY OF THE INVENTION

An object of this invention is to provide a novel rear sight device for mounting on the rear end portion of the receiver of a rifle.

A more specific object of this invention is to provide a novel rear sight device for a rifle including a sight base assembly and a sight component assembly which may be precisely and securely mounted on the receiver of the rifle. The sight base assembly is provided with a vertical plate having vertical planar surfaces which engage the rear surface of the receiver. The sight base assembly also includes locating arms or ears that project forwardly along the vertical side surfaces of the receiver for locating or positioning the sight device. A pivot bolt extending through the locating arms, receiver and cover mounts the rear sight device on the receiver. Adjustment screws urge the planar vertical surfaces of the sight base assembly against the rear vertical surface of the receiver to firmly, accurately and securely mount the rear sight device on the receiver.

DESCRIPTION OF THE PREFERRED EMBODIMENT

Figure 1:
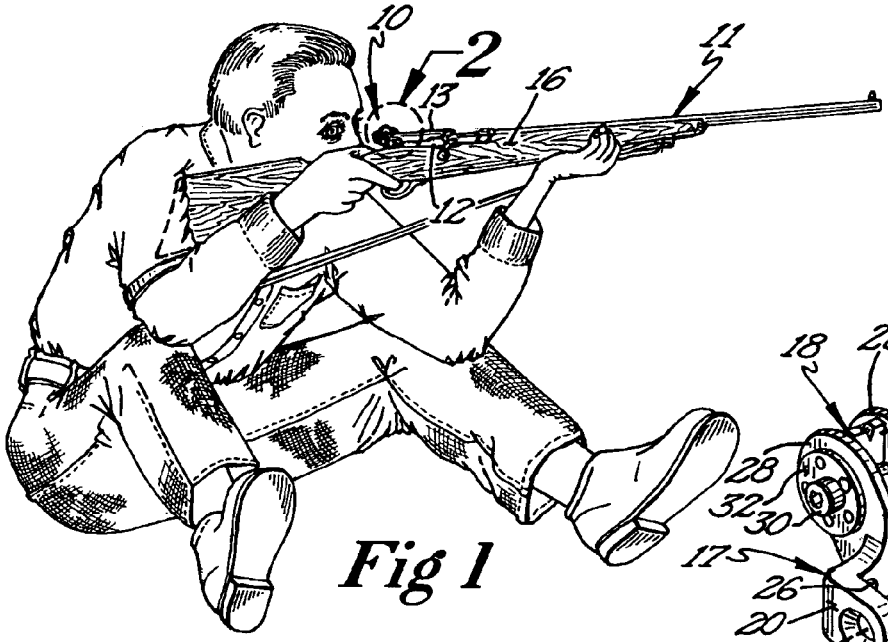
FIG. 1 is a perspective view of a rifle incorporating the novel rear sight device.
Figure 4:
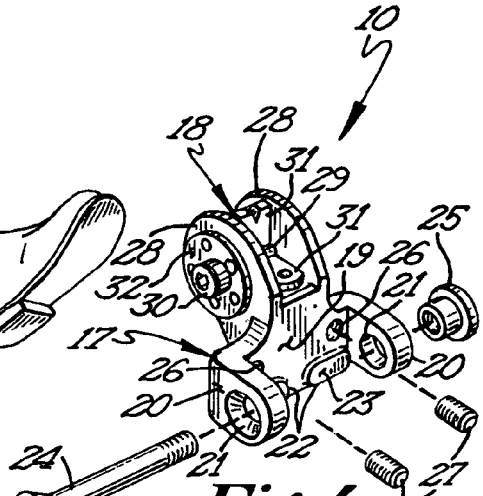
FIG. 4 is an exploded front perspective view of the rear sight device.
Figure 2:
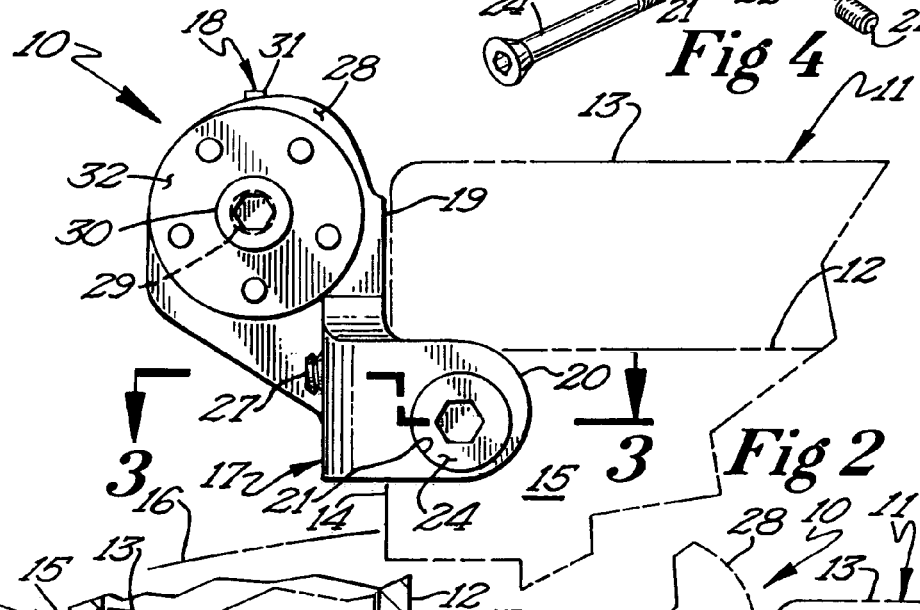
FIG. 2 is a side elevational view of the rear sight device.

Referring now to the drawings and more particularly to FIG. 1, it will be seen that my novel rear sight device, designated generally by the reference numeral 10, is depicted in mounted relation on a rifle. The rear sight device 10 is illustrated in mounted relation on a SKS style rifle 11 although the rear sight device 10 may be used with other rifles having a similar receiver configuration.

The rifle 11 includes a gun stock 16 which supports the receiver 12, cover 13 and barrel which is attached to the receiver. The receiver 12 has a vertical rear wall 14 and vertical side walls 15. The rear surface 14*a* of the rear wall is planar as is the outer surfaces 15*a* of the side walls. The side walls 15 are provided with openings 12*a* while the depending side walls of the cover 13 are provided with openings 13*a*. These openings are arranged in registering relation and constitute the only alteration to the rifle for accommodating the rear sight device 10.

The rear sight device 10 includes a sight base assembly 17 and a sight component assembly 18. The sight base assembly 17 includes a vertical plate 19 having a pair of substantially parallel locating arms or ears 20 projecting forwardly therefrom. The vertical plate 19 and ears 20 constitute a U-shaped mounting frame. The arms 20 are provided with openings 21 which are disposed in registering relation with the openings in the receiver and cover. A pivot bolt 24 extends through the openings 21 in the arms 20, receiver 12 and cover 14 to mount the sight device on the rifle. A retainer nut 25 engages the threaded end of the pivot bolt 24. It will be noted that the locating arms 20 engage the outer surface of the vertical walls of the receiver when the rear sight is mounted on the receiver.

Figure 3:
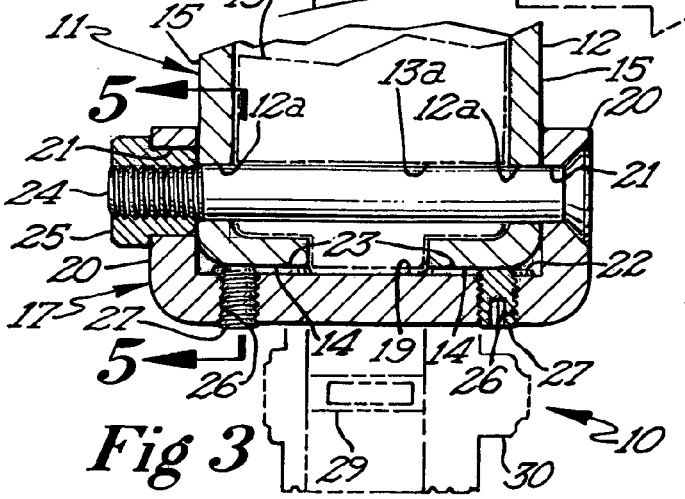
FIG. 3 is a cross-sectional view of the rear sight device taken approximately along line 3—3 of FIG. 2 and looking in the direction of the arrow.
Figure 5:
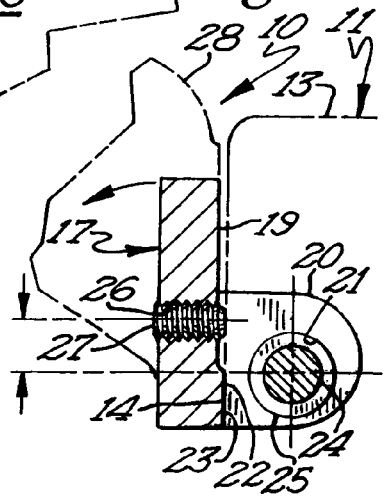
FIG. 5 is a cross-sectional view taken approximately along line 5—5 of FIG. 3 and looking in the direction of the arrows.

It will be noted that the retainer nut includes a threaded sleeve portion integral with the nut head. The threaded sleeve portion of the retainer nut 25 projects through the opening in the arm and the end of the sleeve portion engages the side wall of the receiver as shown in FIG. 3. The retainer nut 25 clamps against one side wall of the receiver when the pivot bolt is tightened. The rear sight device is thereby clamped to the receiver by one locating arm and the retainer nut.

It will be noted that the front surface of the vertical plate 19 is provided with contact pads 22 each having planar vertical surfaces 23. Referring now to FIG. 3, it will be seen that the rear wall of the cover 13 has a width dimension less than the width dimension of the receiver and projects downwardly into a recess in the receiver. The width or lateral dimension of the pads 22 are such that the front surface 23 of the pads do not engage the cover but engage only the rear wall of the receiver. The downwardly projecting rear wall portion of the cover is located between the pads 22.

The vertical plate 19 has a pair of laterally spaced apart threaded openings 26 therein each accommodating an adjustment screw 27. It will be noted that adjustment screws 27 are located above the longitudinal center line axis of the pivot bolt. The rotational axes of the screws 27 are normal to a vertical plane drawn through the center line axis of the pivot bolt 24 when the adjustment screws 27 are advanced, the front face of each screw will engage the rear surface 14*a* of the receiver rear wall to progressively urge the front planar surfaces of the pads in increasing contact with the rear wall of the receiver. The rear sight device is firmly, securely and immovable mounted on the receiver. The outer surfaces 15*a* of the side walls of the receiver 12 serve as locating surfaces for the rear sight device.

The sight component assembly 18, mounted on the unique sight base assembly, includes conventional sight components used on a rear sight for rifles. In the embodiment shown, the sight base assembly 17 includes a pair of arms or ears 28 which project rearwardly and upwardly from the plate 19. The arms 28 are integral with the plate 19 as are the arms 20. The arms 28 are apertured for accommodating a shaft 29. The shaft 29 has an actuator knob 30 secured there to and rotatable with the shaft. Sight elements 31 are secured to a hub which is splined to the shaft 29 for rotation with the shaft. A retainer plate 32 having detents circumferentially arranged thereon is mounted on the shaft and is rotatable with the knob to allow selective positioning of the sight elements, for example, for windage corrections.

From the foregoing, it will be seen that the novel rear sight 10 can be firmly and stationarily mounted on the receiver while requiring only a minimum alteration (pivot bolt holes) to the receiver and cover.

Figure 6:
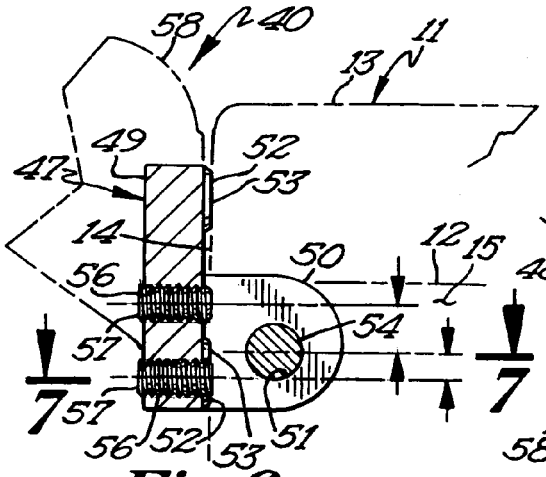
FIG. 6 is fragmentary cross-sectional similar to FIG. 5 but showing a different embodiment of the rear sight device.
Figure 7:
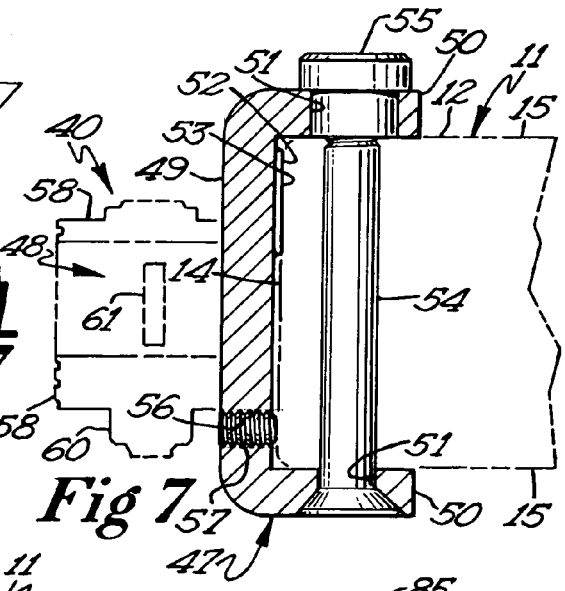
FIG. 7 is a cross-sectional view taken approximately along line 7—7 of FIG. 6 and looking in the direction of the arrows.

Referring now to FIGS. 6 and 7, it will be seen that a different embodiment of the rear sight device, designated generally by the reference numeral 40, is thereshown. The rear sight device includes a sight base assembly 47 and a sight component assembly 48. The embodiment of FIGS. 6 and 7 is similar to the embodiment of FIGS. 1–5 and differs essentially in the location of the vertical plate pads and the location of the adjustment screws.

The sight component assembly 48 is therefore substantially the same as the sight component assembly 18 of FIGS. 1–5. The sight base assembly 47 includes a vertical plate 49 having arms 50 projecting forwardly therefrom. The arms 50 are disposed in substantially parallel relation and engage the outer surface of the side walls 15 of the receiver 12. A pivot bolt 54 extends through the opening 51 in the arms 50 and through registering openings in the receiver and cover the pivotally mount the rear sight device on the receiver. A retainer nut 55 secures the pivot bolt on the sight base assembly and engages a side wall of the receiver in the same manner as the embodiment of FIGS. 1–5.

The vertical plate 49 is provided with a pair of vertically spaced apart pads 52, each having a planer front surface 53. It is pointed out that the pads 52 are located on one side of the vertical plate 49 and are elongate in a transverse or lateral direction as shown in FIG. 7. The rear sight device is also provided with a pair of adjustment screws 57 which engage threaded opening 56 in the vertical plate 49. It will be noted that the screws 57 are vertically spaced apart and are disposed above and below the longitudinal axis or center line of the pivot bolt 54. It will be further noted that the adjustment screws 57 are located adjacent one side of the vertical plate 49 opposite that of the pads 52. In the embodiment shown, the screws are disposed in a single vertical plane and the rotational axis of the screws is normal to a vertical plane drawn through the axis of the pivot bolt.

As pointed out above, the sight component assembly 48 is substantially identical to the sight component assembly of FIGS. 1–5 and includes a pair or rearwardly and upwardly extending arms or ears 58 integral with the vertical plate 49 and disposed in spaced apart parallel relation. The arms 58 are apertured and accommodate a shaft carrying the sight elements 61. An actuator knob 50 is provided for rotating the shaft and for adjusting the retainer plate and the sight elements. When the adjustment screws 57 are advanced, the front surface of the pads will engage the rear surface of the receiver to stabilize the rear sight device in secure relation with the receiver.

Figure 8:
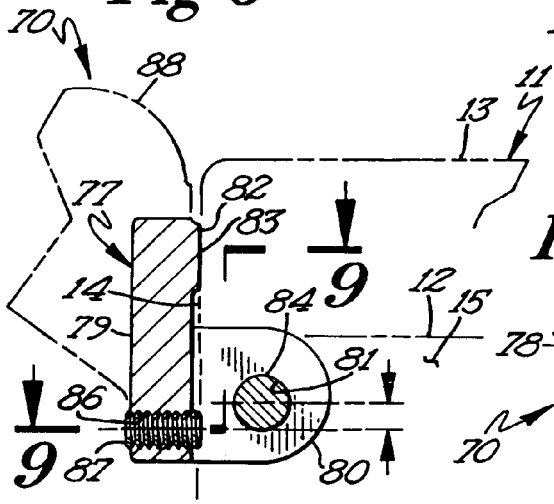
FIG. 8 is a cross-sectional view similar to FIG. 5 but showing another embodiment of the rear sight device.
Figure 9:
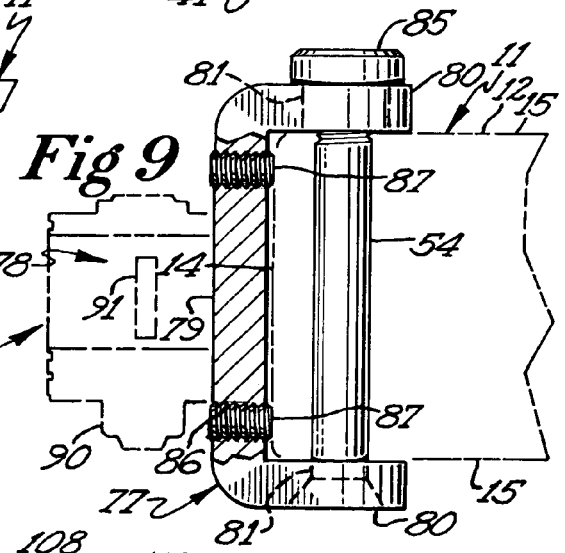
FIG. 9 is a cross-sectional view taken approximately along line 9—9 of FIG. 8 and looking in the direction of the arrows.

Referring now to FIGS. 8 and 9, another embodiment of the rear sight device is thereshown. It is pointed out that the embodiment of the rear sight device 70 shown in FIGS. 8 and 9 differs from the previously described embodiments in the location of the receiver engaging pads on the vertical plate and the location of the adjustment screws. The rear sight device 70 shown in FIGS. 8 and 9 includes a sight base assembly 77 and a sight component assembly 78.

The sight base assembly includes a vertical plate 79 having a pair of forwardly projecting, parallel arms or ears 80 extending therefrom. The arms are provided with openings 81 for accommodating the pivot bolt 84 which also projects through openings in the receiver and cover in the manner of the previously described embodiments. A retainer nut 85 secures the pivot bolt 84 on the sight base assembly. It is again pointed out that the retainer nut engages 85 a side wall of the receiver when the nut is thightned.

The vertical plate 79 is provided with a pair of receiver engaging pads 82 each having planar front vertical surface 83. The pads 82 are laterally spaced apart and are located adjacent the top edge of the vertical plate 79. A pair of adjustments screws 87 are provided and engage threaded openings 86 in the vertical plate 79.

It will be noted that the adjustment screws 87 are located below the center line axis or rotational axis of the pivot bolt 84. The adjustment screws 87 are each located below one of the pads 83. It will be seen that when the adjustment screws are advanced, the front surface of the pads 82 will be tightened and pressed against the rear surface of the receiver. The rear sight device will be stabilized against movement when mounted on the rifle receiver.

The sight component assembly 78 of the embodiment of FIGS. 8 and 9 is also substantially identical to that of FIGS. 1–7. The sight component assembly includes a shaft projecting through apertured arms 88 which are integral with the vertical plate 79. The arms 88 are parallel and sight elements 91 are positioned between the arms on the shaft for movement with the shaft. An actuator knob 90 is secured to the shaft for rotating the shaft and for adjusting the position of a retainer plate.

Figure 10:
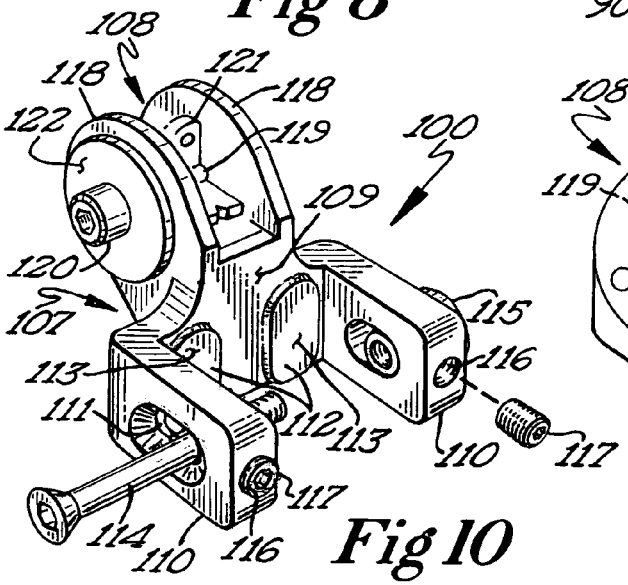
FIG. 10 is a partially exploded perspective view of another embodiment of the rear sight device; and, FIG. 11 is a side elevational view of the rear sight device shown in FIG. 10 with certain parts thereof broken away.
Figure 11:
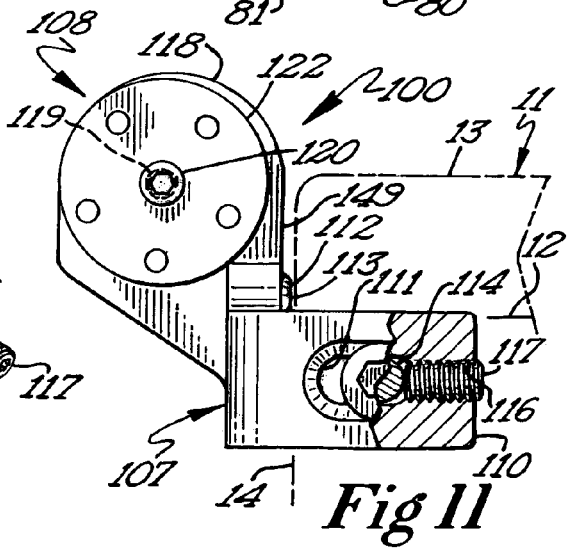

Referring now to FIGS. 10 and 11, it will be seen that another embodiment of the rear sight device is thereshown. The rear sight device 100 includes a sight base assembly 107 and a sight component assembly 108. The sight base assembly is comprised of a vertical plate 109 having a pair of substantially parallel locating arms or ears 110 integral therewith and projecting forwardly therefrom. The arms 110 having openings 111 therein for accommodating a pivot bolt 114 which also projects through openings in the receiver and cover in the manner of the previously described embodiments. A retainer nut 115 retains the pivot in mounted relation on the sight base assembly and engages a side wall of the receiver.

It will be noted that the openings 111 are of elongated configuration in a fore and aft direction. Thus the openings have a longitudinal dimension greater than the diameter of the pivot bolt 114. This arrangement allows limited translational movement of the sight base assembly 107 in a fore and aft direction relative to the pivot bolt 114.

The vertical plate 109 is also provided with receiver engaging pads 112 which are laterally spaced apart and have planer front surfaces 113. The pads 112 have an elongate vertical dimension as shown in FIG. 10. The front surface of each arm 110 is provided with threaded opening 116 therein which communicates with the associated pivot bolt opening 111 in the arm. The threaded openings 116 are threadedly engaged by adjustment screws 117. It will be seen that when the adjustment screws 117 are advanced the sight base assembly will be moved in a forward direction to progressively press the pads 112 against the rear wall of the receiver to thereby stabilize the rear sight device against movement in mounted relation on the rifle.

The sight component assembly 108 includes a pair of upwardly and rearwardly projecting arms 118 each having an opening therein for receiving a shaft 119 there through. An actuator knob 120 is mounted on the shaft for rotatably adjusting the shaft. A plurality of sight elements 121 are secured to a hub which is mounted on the shaft for movement with the shaft. A retainer plate 122 with detents is mounted on the shaft and allows the sight component assembly to be retained in an adjusted position by the detents.

It is pointed out that the sight elements 31 may be provided with a sight hole through which a user looks or the sight element may be provided with a sighting notch. The sight elements may be adjusted in a well known manner for windage corrections.

From the foregoing description, it will be seen that I have provided a novel rear sight device which may be readily mounted on SKS or similar type rifle. The unique rear sight device is mounted on the receiver of the rifle and is stabilized against movement once it is mounted on the receiver.

What is claimed is:

1. A rear sight device for a rifle having a receiver and cover, the receiver having opposed vertical side walls and a vertical rear wall, the cover having opposed vertical side walls, registering openings in the side wall of the receiver and the side walls of the cover, comprising, a sight base assembly and a sight component assembly, said sight component assembly including a mounting member secured to the sight base assembly, sight element means adjustably mounted on the mounting member, said sight base assembly including a vertical plate having planar front surface means, a pair of locating arms projecting forwardly from the vertical plate for engaging the side walls of the receiver, each arm having an aperture therein, the apertures in the locating arms being disposed in registering relation with the openings in the receiver and cover, a pivot bolt adapted to project through the apertures in the locating arms and the openings in the receiver and cover for mounting the sight base assembly on the receiver, adjustment means mounted on the sight base assembly and being adjustable for progressively urging and retaining the planar front surface means of the vertical plate into engaging relation with the rear wall of the receiver.

2. The rear sight device as defined in claim 1 wherein the locating arms are integral with the lower portion of the vertical plate and project forwardly therefrom.

3. The rear sight device as defined in claim 2 wherein said planar front surface means includes a pair of pads on the front surface of the vertical plate, each pad having a planar front surface for engaging the rear wall of the receiver when the rear sight is mounted on a rifle.

4. The rear sight device as defined in claim 3 wherein said adjustment means comprises a pair of elements adjustably mounted on the vertical plate and being adjustable to urge the planer front surface means against the rear wall of the receiver.

5. The sight device as defined in claim 4 wherein said adjustment elements are threaded and threadedly threaded openings extending through the vertical plate.

6. The rear sight device as defined in claim 5 wherein said threaded adjustment elements are positioned below the center line axis of the pivot bolt.

7. The rear sight device as defined in claim 5 wherein said threaded adjustment elements are located above the center line axis of the pivot bolt.

8. The rear sight device as defined in claim 5 wherein one of said threaded adjustment elements is located above the center line axis of the pivot bolt and the other threaded adjustment element is located below the center line axis of the pivot belt.

9. The rear sight device as defined in claim 3 wherein the aperture in each arm is of elongate configuration, the longitudinal dimension of the aperture being greater than the vertical dimension enabling relative translational movement of the sight base assembly and pivot bolt, a threaded opening in an end of each arm, adjustment screws engaging the threaded opening and when advanced moving the pads into engaging relation with the rear wall of the receiver.

10. A rear sight device for a rifle having a receiver and a cover, the receiver having opposed vertical side walls and a vertical rear walls, the cover having opposed vertical side walls, registering openings in the side walls of the receiver and the side walls of the cover, comprising, a sight base assembly and a sight component assembly, said sight component assembly including a pair of mounting arms secured to the sight base assembly, sight elements adjustable mounted on the mounting arms, said sight base assembly including a vertical plate having a pair of pads on the front surface thereof, said pads having planar surfaces, a pair of locating arms integral with the lower portion of the vertical plate and and projecting therefrom for engaging the side walls of the receiver, each arm having an opening there through disposed in registering relation with the openings in the receiver and cover, a pivot bolt adapted to project through the openings in the locating arms and openings in the receiver and cover for mounting the sight base assembly on the receiver, said sight base assembly having a pair of threaded openings therethrough, a pair of threaded screws engaging said threaded openings and being adjustable for urging the pads into engaging relation with the rear wall of the receiver.

11. The rear sight device as defined in claim 10 wherein the threaded openings in the sigh base assembly are in the vertical plate and are disposed above the longitudinal center line of the pivot bolt.

12. The rear sight device as defined in claim 10 wherein the threaded openings in the sight base are in the vertical plate and are disposed below the longitudinal center line of the pivot bolt.

13. The rear sight device as defined in claim 11 wherein said pads are positioned below the threaded openings and adjustment screws and have a lateral dimension greater than the vertical dimension.

14. The rear sight device as defined in claim 12 wherein each pad is positioned above one of said adjustment screws and adjacent the top edge of the vertical plate.

15. The rear sight device as defined in claim 10 wherein said threaded openings are in the ends of said locating arms and each opening communicating with said pivot bolt opening in the arm, advancement of the adjustment screws moving the pads of the vertical plate into engaging relation with the rear wall of the receiver.

16. The rear sight device as defined in claim 15 wherein said pads each have a vertical dimension greater than the corresponding width dimension.

* * * * *